US006543368B1

(12) United States Patent
Forbes

(10) Patent No.: US 6,543,368 B1
(45) Date of Patent: Apr. 8, 2003

(54) COIL CAR STRUCTURE

(75) Inventor: James W. Forbes, Campbellville (CA)

(73) Assignee: National Steel Care Limited, Hamilton (CA)

( * ) Notice: Subject to any disclaimer, the term of this patent is extended or adjusted under 35 U.S.C. 154(b) by 0 days.

(21) Appl. No.: 09/169,221

(22) Filed: Oct. 9, 1998

(51) Int. Cl.[7] ..... B61D 17/00
(52) U.S. Cl. ..... 105/396; 410/42; 410/49
(58) Field of Search ..... 105/396, 377.01, 105/377.08, 355, 404, 406.1, 413, 418, 419; 410/42, 45, 49, 36, 44, 47, 50

(56) References Cited

U.S. PATENT DOCUMENTS

| | | | | |
|---|---|---|---|---|
| 2,494,404 A | | 1/1950 | Nixon | |
| 2,991,734 A | | 7/1961 | Gabriel | |
| 3,291,072 A | | 12/1966 | Cunningham | |
| 3,307,495 A | * | 3/1967 | Chapman et al. | 410/49 |
| 3,376,062 A | | 4/1968 | Chosy et al. | |
| 3,465,692 A | | 9/1969 | Hyatt | |
| 3,581,674 A | | 6/1971 | O'Leary | 105/367 |
| 3,628,466 A | | 12/1971 | Lyons et al. | |
| 3,658,011 A | | 4/1972 | West et al. | |
| 3,658,195 A | | 4/1972 | Fantin | |
| 4,451,188 A | | 5/1984 | Smith et al. | |
| 4,782,762 A | * | 11/1988 | Johnstone et al. | 105/404 |
| 4,805,539 A | * | 2/1989 | Ferris et al. | 105/355 |
| 4,841,876 A | * | 6/1989 | Gramse et al. | 105/406.1 |
| 5,085,152 A | * | 2/1992 | Tylisz et al. | 105/404 |
| 5,170,717 A | | 12/1992 | Richmond et al. | 105/377 |
| 5,191,842 A | | 3/1993 | Tinkler | 105/355 |
| 5,211,518 A | * | 5/1993 | Mimica | 410/50 |
| 5,562,046 A | * | 10/1996 | Fetterman et al. | 105/419 |
| 5,622,116 A | * | 4/1997 | Carlton | 105/355 |
| 6,077,005 A | * | 6/2000 | Westlake | 410/49 |

OTHER PUBLICATIONS p. 285, Car and Locomotive Cyclopedia 1966 Edition.
p. 286, Car and Locomotive Cyclopedia 1966 Edition.
p. S3–62, Car and Locomotive Cyclopedia 1974 Edition.
p. 149–152, Car and Locomotive Cyclopedia 1980 Edition.
p. S3–60, Car and Locomotive Cyclopedia 1974 Edition.

* cited by examiner

*Primary Examiner*—S. Joseph Morano
*Assistant Examiner*—Lars A. Olson
(74) *Attorney, Agent, or Firm*—Hahn Loeser + Parks; Stephen L. Grant

(57) ABSTRACT

A railcar unit has a pair of deep sidewalls and a cradle mounted between the sidewalls for carrying coils. The sidewalls span the distance between the two railcar trucks, and act as a pair of deep beams for carrying vertical loads. The deep sidewalls are arranged to extend above and below the center sill of the cradle and to give vertical stiffness to the car. The center sill is a straight through sill for carrying buff and draft loads between the couplers. The cradle is made from a set of cross bearers welded to the center sill to form a series of segmented beams, covered by plating. The cross bearers are welded to the sidewalls at lap joints. The cross bearers are all of the same design and can be made from a rolled beam. The sidewalls have their deepest section at mid-span, and are tapered to a thinner section toward the end structure of the cars. The tapering includes provision of an access way between the railcar truck wheels and the sidewall to permit brake maintenance.

28 Claims, 11 Drawing Sheets

COIL CAR STRUCTURE

FIELD OF THE INVENTION

This invention relates to improvements in the structure railway cars for carrying metal coils, commonly referred to as coil cars.

BACKGROUND OF THE INVENTION

Coils of steel sheet are often carried by rail cars. Coils can be mounted either longitudinally or transversely. In a longitudinal mounting, the axis of revolution of the coil is aligned to be substantially parallel with the rolling, or longitudinal, direction of the rail car. A longitudinal mounting often has the appearance of a single long trough with a number of moveable intermediate dividers. In a transverse mounting, the axis of revolution of the coil is aligned across the tracks, that is, perpendicular to the rolling direction of the rail car. Transverse mounting cars have a number of parallel bunks, rather than one long trough. A bunk is generally V-shaped, and the coil sits in the bunk with the outer circumference of the coil tangent to the V at two points such that it cannot roll. The V-shaped bunks are generally lined with wood decking to act as cushioning, thereby discouraging damage to the coils during loading or travel.

In earlier times flat cars were converted to function as coil cars by adding bunks on to the flat car deck to prevent the coils from rolling off the deck during transport from the rolling mill to the customer. The basic structure of a flat car includes a main center sill that is box shaped in cross-section. The center sill of this kind of car is the main structural member of the car and runs from one end coupling of the car to the other. The center sill is the primary load path of the car both for longitudinal buff and draft loads from coupler to coupler, and for carrying the vertical load bending moment between the trucks. A wide deck is mounted above the center sill of this kind of car. Often, alternating cross-bearers and cross ties extend outwardly from the central sill. The cross bearers tend to be of deeper section and provide the majority of the support for the outboard regions of the deck.

Over time, the size and weight of coils that can be carried has increased. The flat car design has evolved to have stronger and bigger main sills, sometimes reinforced by doubled sections. Further, the central sill may not necessarily be of constant section, but may have a "fish belly" profile. That is, the depth of section of the centre sill can increase toward the mid-section of the railcar to correspond to the increase in bending moment at mid-span between the rail car trucks. Further, longitudinal stringers, in the form of I-beams or wide flange beams have been located above the deck level to form the upper lip of the longitudinal bunk. In another step in the evolution of the flat car design, some or all of the flat decking can be replaced by canted decking to form the V-shaped trough. In more recent times the flat decking has been removed entirely, to leave a railcar having a dominant centre sill, a pair of elevated outboard longitudinal beams, cross-bearers cantilevered out from the centre sill like ribs; and V-shaped decking to form the trough.

The present inventor has taken a different approach. Rather than having a dominant center sill, the inventor employs a pair of outboard beams of relatively deep section. The coil carrying bunk is then supported at its lateral ends to extend between the two deep side beams. A car with a pair of deep beams, well separated also has superior lateral bending resistance to a narrower car.

In terms of fabrication, it is advantageous to reduce the number of different parts used in an assembly. To that end, it would be advantageous to replace the traditional arrangement of alternating cross-ties and cross-bearers with a single design of cross-bearer. When the cross-bearer is designed conceptually as a cantilevered arm or rib, it is not uncommon for the root of the arm to be of a deeper section than the tip, reflecting the relatively large moment that must be carried at the root of the arm. However, a tapered section is not as convenient as a section of constant depth. A section of constant depth can be produced by a rolling mill, and is less likely to have welding defects or irregularities than a fabricated section. By contrast, when the cross-bearer is in concept more akin to a beam supported at two ends, the use of a section of constant depth is not inappropriate.

The use of a deep side beam presents the opportunity for improving the connection at the outboard tips of the cross-bearers. Formerly, the use of I-beam or wide flange beams at the upper and outer lips of the trough did not always present a convenient welding arrangement. The cross-bearer end could be trimmed to match the profile of the I-beam web, or the flange of the I-beam could be trimmed back locally to accommodate the cross-bearer tip. In either case the cross-bearer tip would butt against the I-beam section. When deep side beams are used, the beams themselves have intermediate vertical stiffeners to discourage the relatively thin webs of the beams from buckling. At the same time, the stiffeners present a flat surface, in the same plane as the plane of the web of the cross-bearer, against which a lap joint can be formed. Not only can a better joint be formed, but the fit-up process in manufacturing is, in the view of the present inventor, easier. That is, the pre-existing vertical stiffener of the beam acts as a longitudinal stop for the outboard tip of the cross-bearer, automatically locating it in the correct position.

Access for brake maintenance on a car with deep side walls may be limited. To address this concern the present inventor has eased the downward profile of the side beams to permit improved access to the brakes between the trucks and the mid-span portion of the car.

SUMMARY OF THE INVENTION

The present invention provides, in a first aspect, a rail car for carrying metal coils, comprising a pair of end structures each mounted on a rail car truck, a pair of side beams extending between the end structures, and a transverse cradle, for cradling metal coils, mounted between the side beams. The cradle has a longitudinally extending low central portion. The lowest point of the low central portion lies at a height that is at least as high as the lowest extremity of the side beams.

In an additional feature of that aspect of the invention, the railcar has, at a transverse-section between said trucks, a second moment of area about a horizontal neutral axis, and the side beams contribute at least half of the second moment of area of the section. In another additional feature of that aspect of the invention, the side beams of the rail car contribute at least three quarters of the second moment of area of the section. In a still further additional feature of that aspect of the invention, the side beams of the railcar contribute at least 90% of the second moment of area.

In still another further additional feature of that aspect of the invention, at a transverse section between the trucks, the location of the maximum longitudinal tensile stress under a gravity load is in the lowest chord of one of the side beams.

In yet another additional feature of that aspect of the invention, at a transverse section between the trucks, the location of maximum longitudinal compressive stress under a gravity load is in the highest chord of one of the side beams. In still another additional feature of that aspect of the invention, the cradle has a center sill extending longitudinally along the low central portion.

In still yet another additional feature of that aspect of the invention, the central sill has a top flange and a bottom flange, the rail car has, at a transverse section between the trucks, a neutral axis for bending under gravity loads, and the neutral axis lies at a height that is between the height of the top and bottom flanges.

In another additional feature of that aspect of the invention, the cradle includes cross-bearers connected to the side beams. In still yet another feature of that aspect of the invention, in at least a medial portion of the rail car between the trucks, the cross bearers are of substantially uniform design. In a further feature of that aspect of the invention, at least a medial portion of the rail car between the trucks is of the type chosen from the set of rail car types consisting of rail car portions that are free of cross-ties and rail car portions in which the number of cross ties is fewer than two thirds as many as cross bearers.

In still a further additional feature of that aspect of the invention, the rail car has a through centre sill of substantially constant cross-section. In still yet a further additional feature of that aspect of the invention, over at least the medial portion of the rail car, the cross-bearers are of substantially uniform design. In another further additional feature of that aspect of the invention, at least the medial portion of the rail car is of a type chosen from the set consisting of types that are free of cross-ties, and types that have less than two-thirds as many cross-ties as cross-bearers.

In another aspect of the invention, there is a rail car for carrying metal coils comprising a pair of end structures each mounted on a rail car truck, a pair of side beams extending between the end structures, a transverse sling, for cradling metal coils, slung between the side beams, the rail car having a set of brakes, and at least one of the side beams having a relief permitting access to the brakes.

In an additional feature of that aspect of the invention, the relief is located adjacent the truck. In another additional feature of that aspect of the invention, the one beam has a relief adjacent each of the trucks. In still another additional feature of that aspect of the invention, both the beams have reliefs adjacent the trucks.

BRIEF DESCRIPTION OF THE DRAWINGS

For a better understanding of the present invention and to show more clearly how it may be carried into effect, reference will now be made by way of example to the accompanying drawings, which show an apparatus according to the preferred embodiment of the present invention and in which.

DETAILED DESCRIPTION OF THE PREFERRED EMBODIMENT

Figure 1:
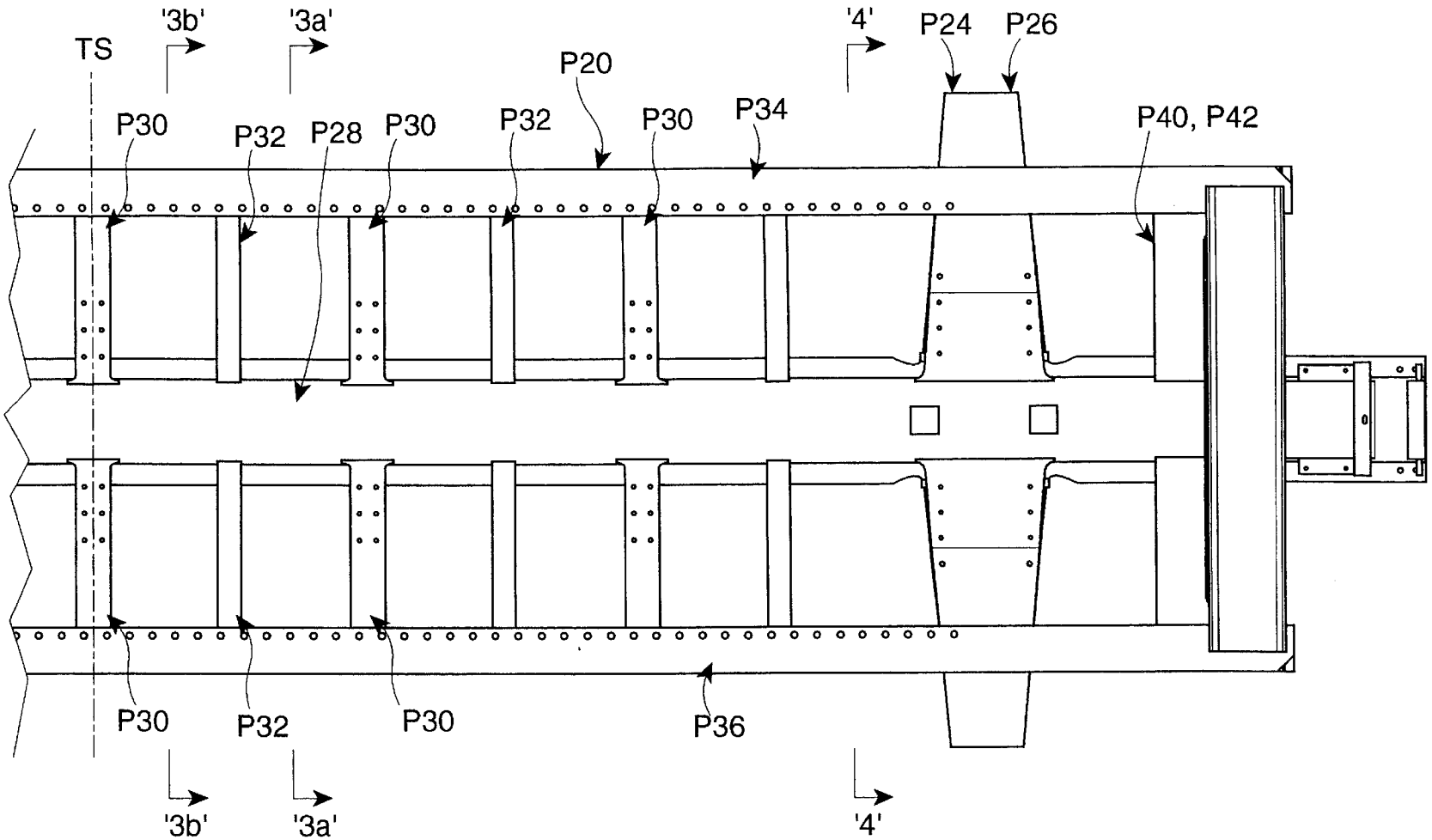
FIGURE 1 (Prior Art)
FIG. 1 is a top view of a prior art coil car.
Figure 2:
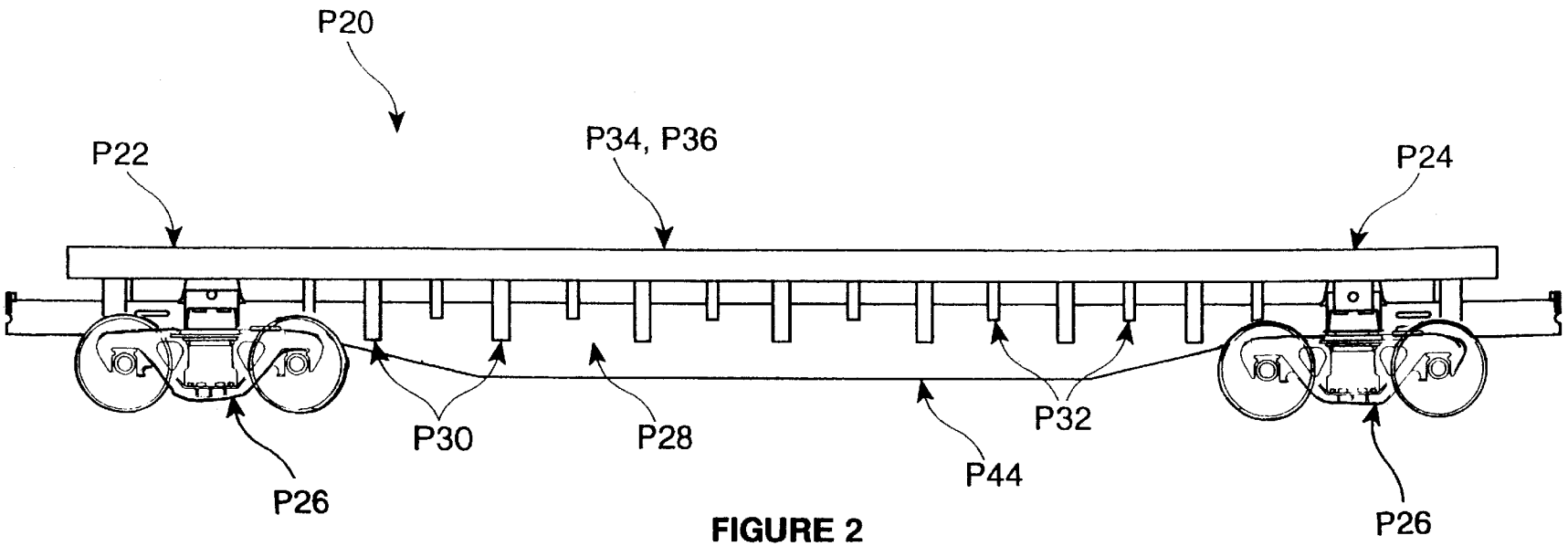
FIGURE 2 (Prior Art)
FIG. 2 is a side view of the prior art coil car of FIG. 1.

The description which follows, and the embodiments described therein, are provided by way of illustration of an example, or examples of particular embodiments of the principles of the present invention. These examples are provided for the purposes of explanation, and not of limitation, of those principles and of the invention. In the description which follows, like parts are marked throughout the specification and the drawings with the same respective reference numerals. The drawings are not necessarily to scale and in some instances proportions may have been exaggerated in order more clearly to depict certain features of the invention.

For the purposes of better understanding the present invention, a number of illustrations of a prior art rail car are included by way of comparison. The prior art rail car is indicated generally in FIGS. 1, 2, 3*a*, 3*b* and 4 as P20. It has a pair of rail car end structures P22 and P24, each having a main bolster P26. A main center sill is indicated as P8. Ribs branch outwardly from main center sill P28 and are indicated as cross-bearers P30 and thinner cross-ties P32. The outer tips of cross-bearers P30 and cross ties P32 meet with one or other of a pair of wide flange beams P34 and P36. A generally V-shaped deck P38 runs the length of the car, spanning the pitches between cross-beams P30 and cross-ties P32 to terminate at end bulkheads P40 and P42. Main center sill P28 has a generally box-shaped rectangular section that has a deep central belly P44, shown in FIGS. 3*a* and 3*b*. Main center sill P28 has an upper flange P46 and a thick central lower flange P48.

Figure 3A:
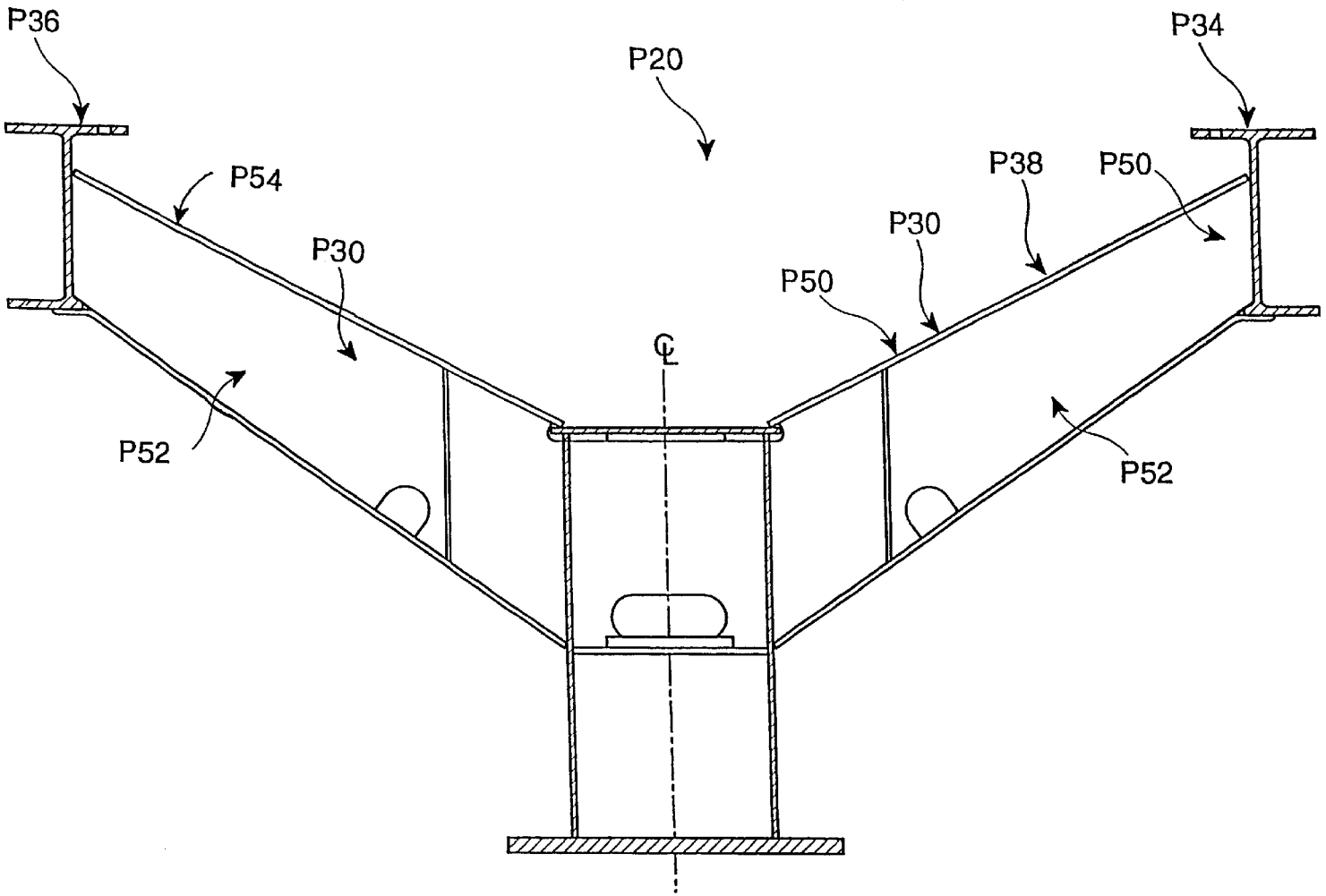
FIGURE 3a (Prior Art)
FIG. 3*a* is a cross-sectional view on section '3*a*—3*a*' of the prior art coil car of FIG. 1.

In the particular embodiment illustrated, the overall depth of main center sill P28 at central belly P44 is 28 inches. The weight of main center sill P28 is 150 lbs per lineal foot, and its width is 22 inches over the lower flange P48. The thickness of bottom flange P48 is 1 inch and the thickness of the remainder of main center sill P28 is ⅜ inches thick. Wide flange beams P34 and P36 are 13.8 inches deep at 34.3 lbs. per lineal foot each. The overall weight of section is roughly 261 lbs. per lineal foot with a neutral axis in bending located 22.9 inches above top of rail, undeflected design height. The local neutral axis of main center sill P28 is located about 23.3 inches above TOR, and the local neutral axis of each of the wide flange beams is located about 56.8 inches above TOR. The second moment of area of the section shown in FIG. 3*a* is about 24,300 $in^4$. Of this, 50% can be attributed to the influence of main center sill P28.

At the mid-span line of car P20, it is expected conceptually that a large coil, such as an 84 inch diameter coil, will tend to place the top flange of cross bearers P30 in tension and the lower flange in compression.

Figure 3B:
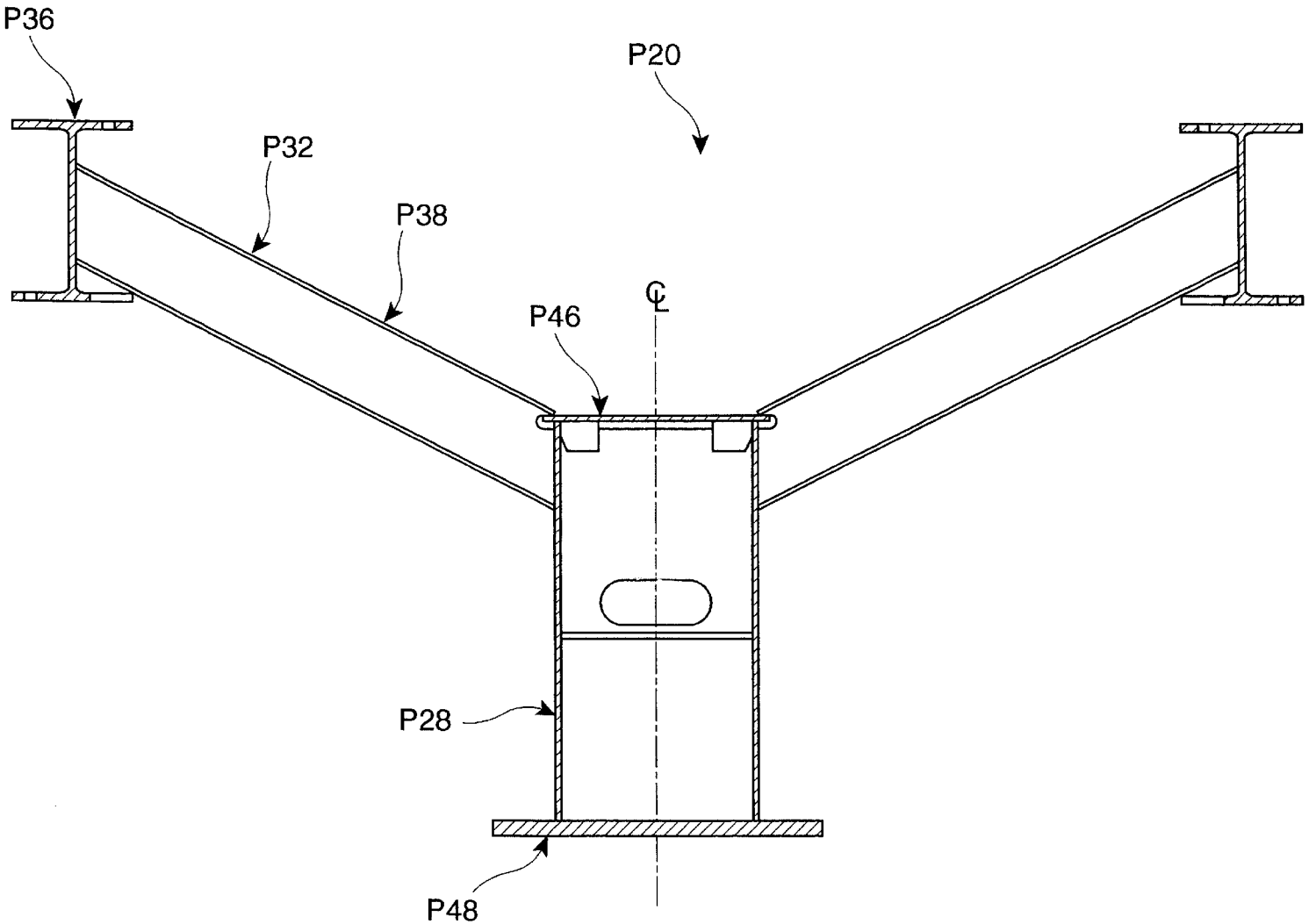
FIGURE 3b (Prior Art)
FIG. 3*b* is the other cross-sectional view on section '3*b*—3*b*' of FIG. 1.
Figure 4:
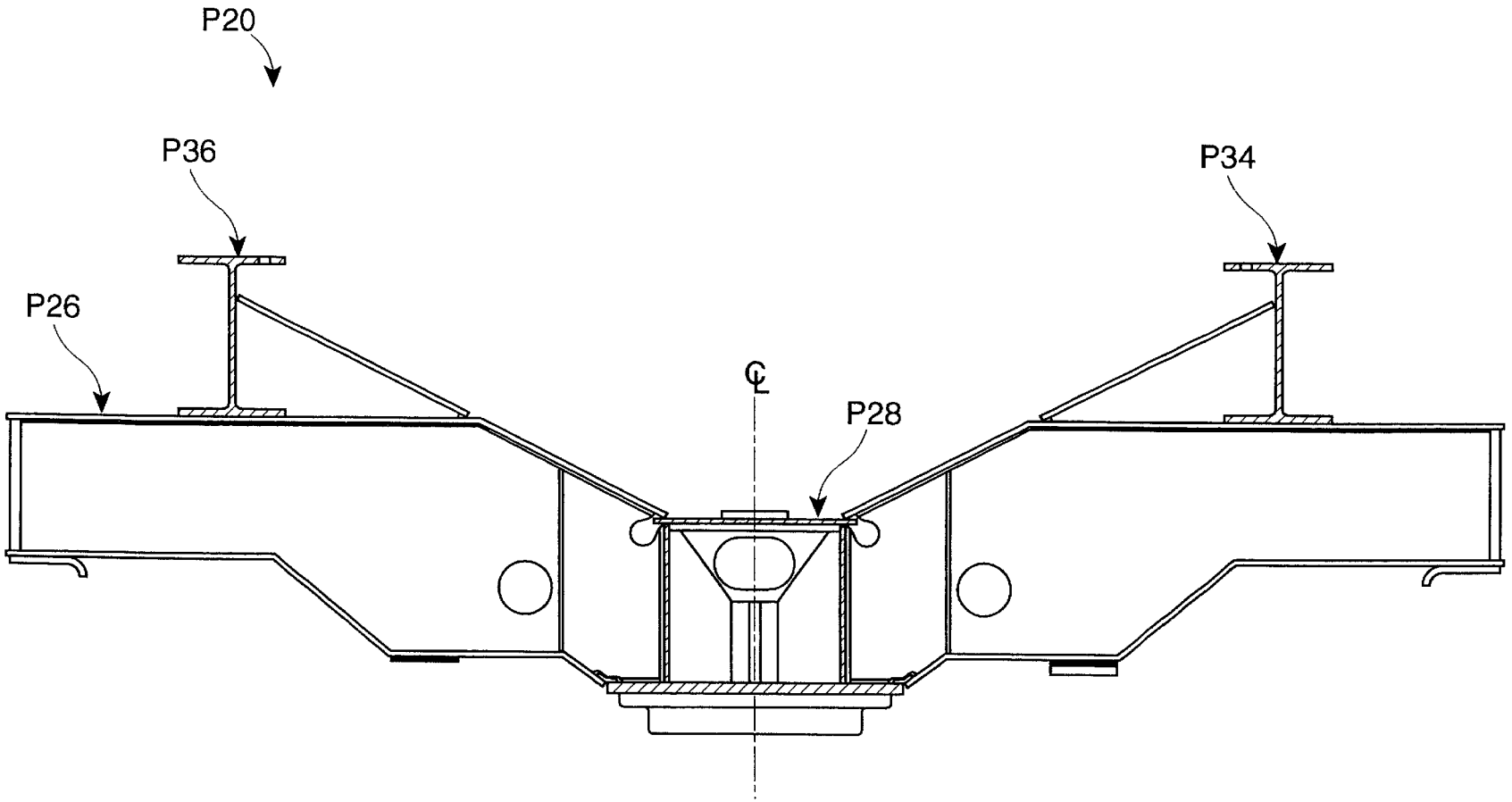
FIGURE 4 (Prior Art)
FIG. 4 is a sectional view on section '4—4' of the prior art coil car of FIG. 1.

In FIG. 3*a*, wide flange beam P36 has been trimmed locally to admit the distal tip P50 of cross-bearer P30, such that the end of the tapered web P52 and upper flange P54 of cross-bearer P30 abut the vertical web of wide flange beam P36. Cross beam P30 and wide flange beam P36 are fillet welded together in this orientation. A similar arrangement is shown in FIG. 3*b* for cross-tie P32 and wide flange beam P34.

Figure 5A:
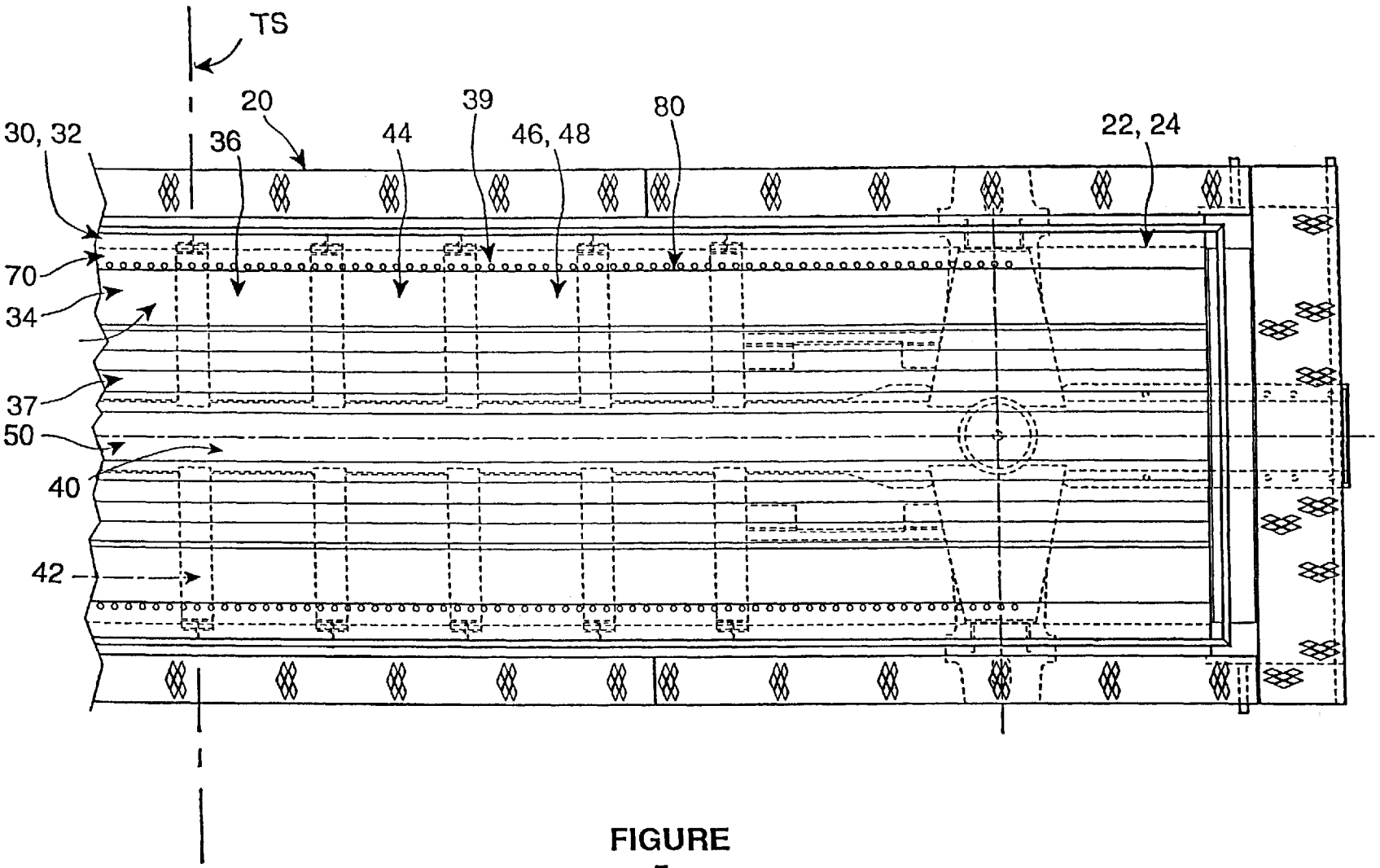
FIG. 5*a* is top view of a rail car according to the present invention.
Figure 5B:
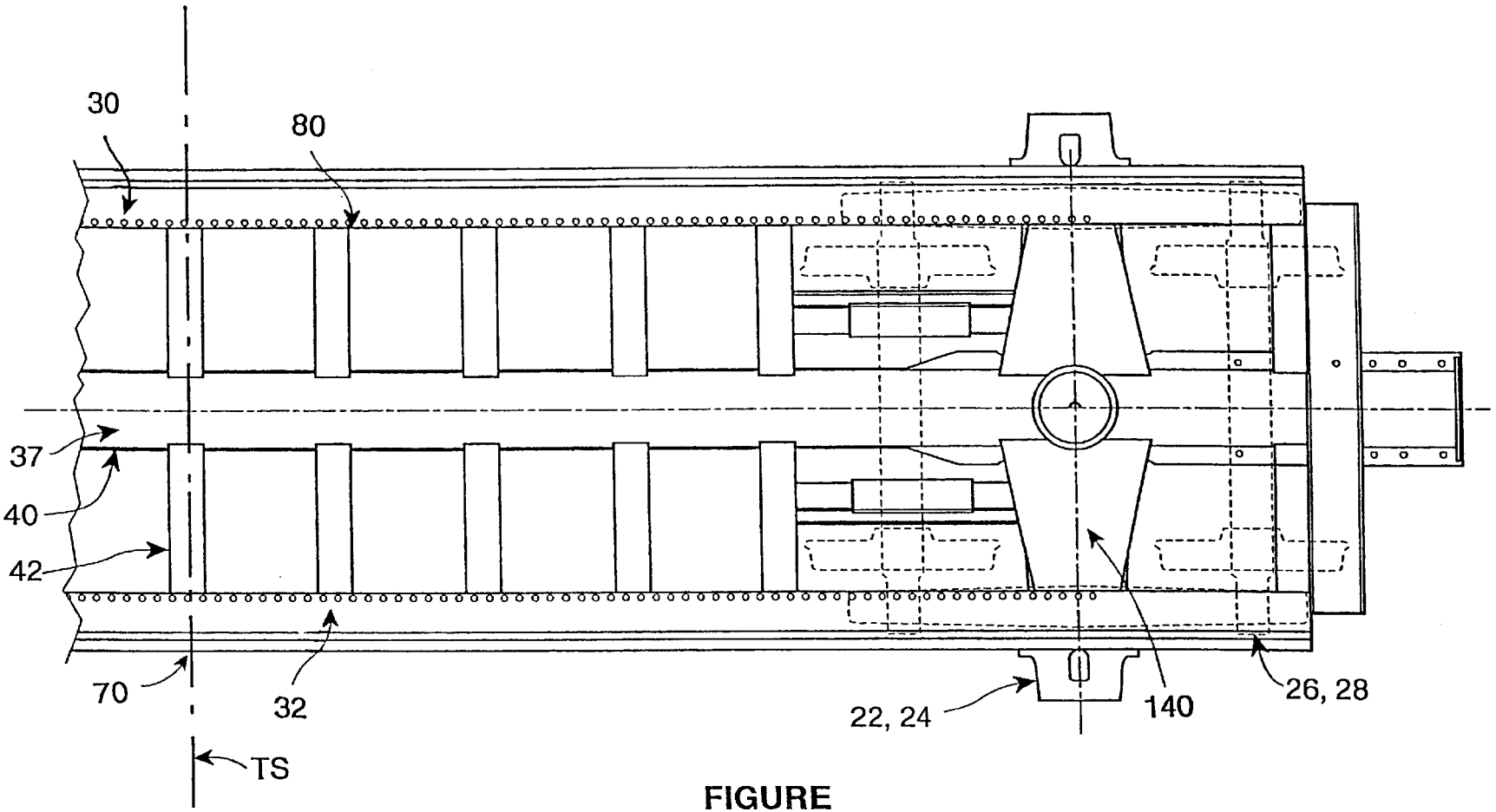
FIG. 5*b* is a top view of the rail car of FIG. 5*a* with decking removed to show the skeletal structure of the rail car.

By contrast, an example of a rail car embodying the present invention is illustrated s in FIG. 5*a*. For the purposes of conceptual explanation the embodiments illustrated in FIGS. 5*a*, 5*b*, 6, 7, 8*a* and 8*b*, the major structural elements are both symmetrical about the longitudinal centerline of the car (as designated by axis CL) and symmetrical about the mid-span transverse section of the car, indicated as TS. In reality a number of secondary and tertiary brake fittings, handrails, brackets, cables and other ancillary features that do not have appreciable effect on the structural performance of the car may not necessarily be symmetrical about either centerline.

A rail car is indicated generally as 20. It has a pair of end structures 22 and 24 for mounting on a pair of rail car trucks 26 and 28 respectively. A pair of left and right hand side beams 30 and 32 extend between end structures 22 and 24, and form the main longitudinal structural elements of rail car 20 for resisting gravitational loads. A cradle 34 is hung between beams 30 and 32. Cradle 34 resembles a trough, and is shaped to cradle steel coils, or other similar loads, between its inwardly and downwardly sloping shoulders 36. Shoulders 36 are lined with wooden decking 37 placed to accommodate coils ranging between 30 and 84 inches in diameter. When coils are loaded in cradle 34 they are discouraged from longitudinal sliding by end bulkheads 35 and by moveable bulkheads 38 whose locating pins seat in the indexed apertures of left and right hand locating plates 39.

The structure of cradle 34 includes a center sill, 40, cross-bearers 42 extending between center sill 40 and one or the other of side beams 30 and 32, and deck plates 44. Deck plates 44 include right and left hand slope plates 46, and 48 of shoulders 36, welded to the upper flanges of cross-bearers 42 and to the upper flange 50 of center sill 40. Center sill 40 includes, in addition to upper flange 50, a pair of parallel vertical webs 52 and 54 and a lower flange 56. Center sill 40 is a through-center-sill, that is, it runs from one end of rail car 20 to the other, and is of substantially constant section throughout its length. Internal gussets 57 are welded inside center sill 40 to provide web continuity at each cross-bearer location. Center sill 40 has an overall depth of 12.719 inches. Upper flange 50 is 15 inches wide and 0.50 inches thick. Lower flange 56 is 16 inches wide and 0.50 inches thick. Vertical webs 52 and 54 are each 11.719 inches high and 0.375 inches thick. The overall weight of the section is 82.3 lbs per lineal foot, and its local moment of inertia in longitudinal bending, that is its second moment of area about its transverse neutral axis, is 664 $in^4$.

Since rail car 20 is symmetrical, for the purposes of the present description it will be understood that the structure of side beams 30 and 32 is identical. Each has an upper flange assembly 70, a lower flange assembly 72, and webbing 74. Examining each of these in turn, upper flange assembly 70 has a top chord member in the nature of a hollow rectangular steel tube 76, upon which pin locating plate 39 is mounted. Plate 39 has an inwardly extending perforated tongue, 80, the perforations having a constant pitch, and being of a size and shape suitable for engagement by the locating pins of moveable bulkheads 38. Also located intermittently along a more outboard region of plate 39 are tie-down eyes 84 for locating a cowling or cover to protect coils mounted on coil car 20 from being exposed to the rain and snow. Lower flange assembly 72 includes a main lower sill member in the nature of a hollow rectangular tube 86 to which a ¾" thick steel lower sill reinforcement 88 has been added. Webbing 74 includes a substantially vertical steel web 90 welded at lap joints to the respective outer faces of steel tube 76 and rectangular tube 86. Vertical braces 92 extend between tubes 76 and 86 along the inner face of web 90 at regular spacings along the length of beams 30 and 32. A cantilevered walkway 94 is mounted on brackets 98 located on the outboard face of web 90.

Over the mid span section of car 20, that is, the portion of car 20 at which side beams 30 and 32 have their maximum depth, the overall second moment of area of each side beam 30 or 32 is about 14,800 $in^4$. The weight of each side beam section is about 100 lbs. per lineal foot. Each of side beams 30 and 32 provides just over 45% of the total second moment of area of the mid span section of car 20.

Figure 7:
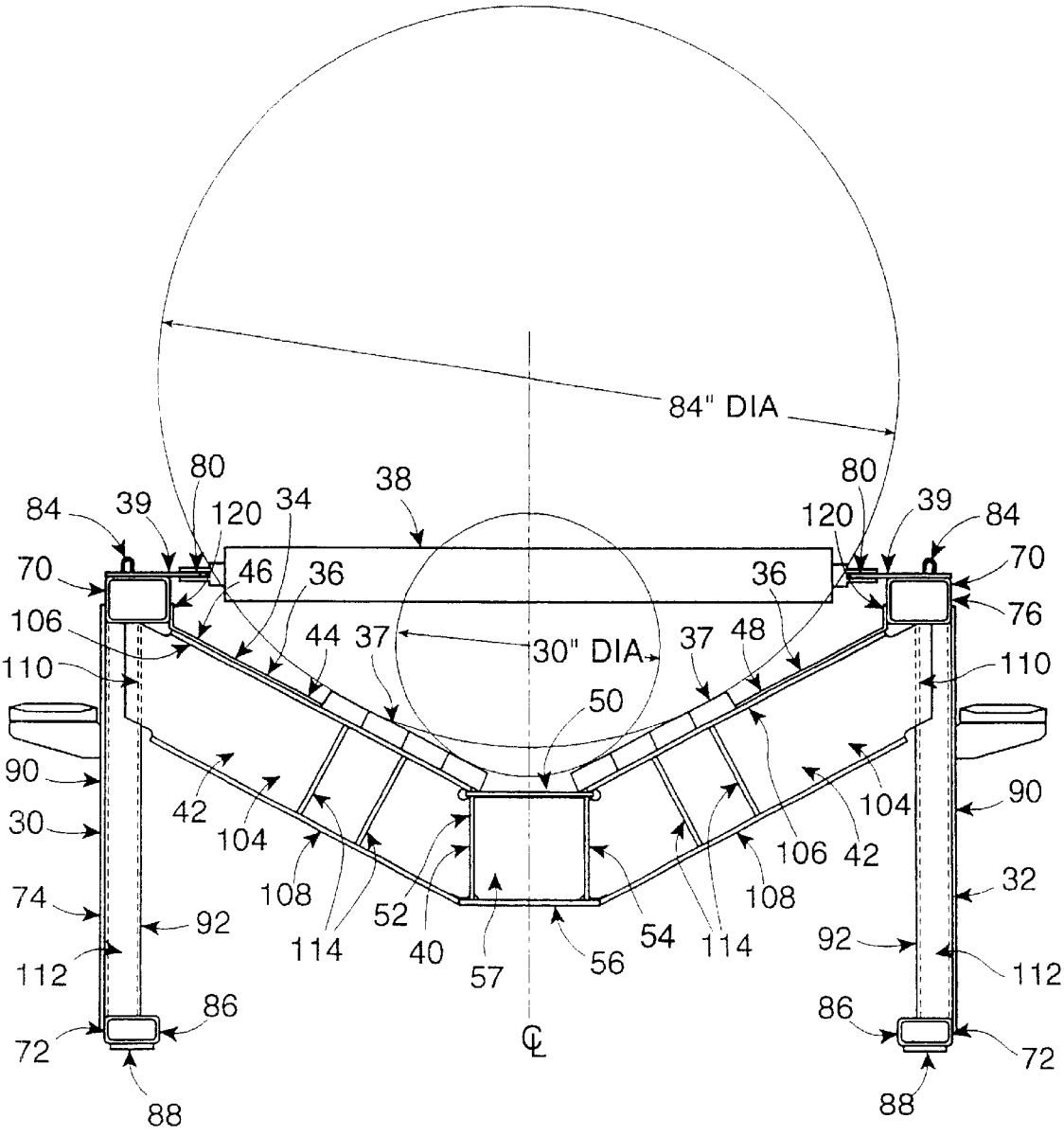
FIG. 7 is a cross section of the rail car of FIGS. 5*a* and 5*b* at mid span.

The joining of cradle 34 to each of side beams 30 or 32 is typically as shown in FIG. 7. Deck plate 44 has a vertical upturned lip 102 that is welded along the inwardly facing side of steel tube 76. The web 104 of cross bearer 42 extends beyond the ends of its upper and lower flanges 106 and 108 and is cut on a mitre to yield a substantial tab 110 suitable for welding in a lap joint to the longitudinally facing side 112 of vertical brace 92. The joint is welded at a fillet along the corner of vertical brace 92 on one face of tab 110, and at a fillet along the distally extreme edge of tab 110 to side 11Z. In this way the joint is intended to place the weldmetal predominantly in shear. Web 104 also has intermediate gussets 114 to provide reinforcement in the region of wooden decking 37. Wooden decking 37 is provided for the known purpose of cushioning metal coils loaded in car 20, as noted above.

Figure 6:
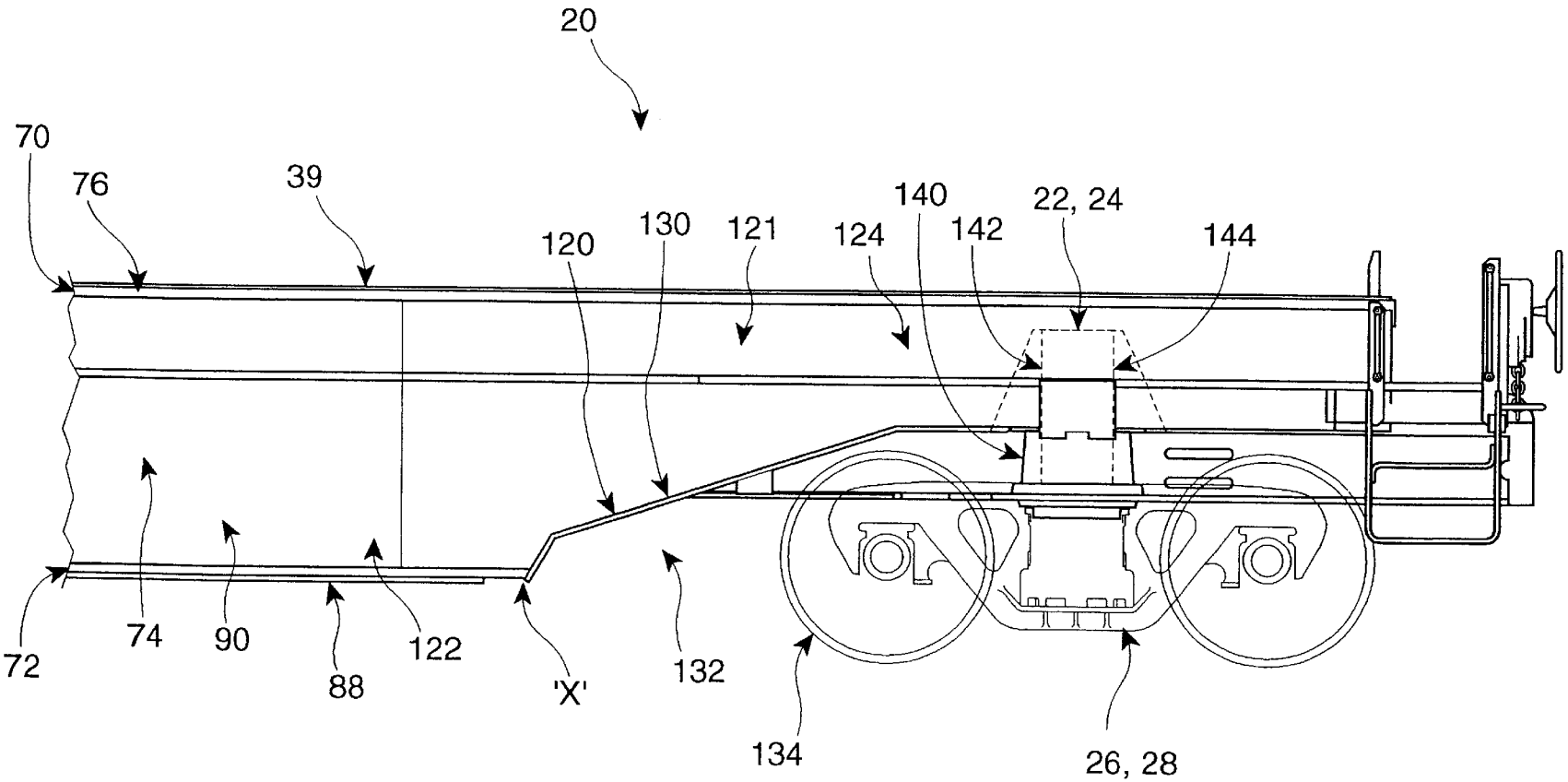
FIG. 6 is a side view of half of the rail car of FIGS. 5*a* and 5*b*.

Considering the side view of car 20 shown in FIG. 6, moving away from the mid span centerline of car 20 on Transverse Section TS, the section of greatest depth ends at a point designated as 'X'. Lower sill reinforcement 88 ends, and hollow rectangular tube 86 is obliquely truncated and welded to a doglegged upsweep flange 120. Flange 120 follows the lower edge of web 90 as it narrows in a transition portion 121 from the deep, mid span portion, 122 to the narrow, or shallow, end structure portion 124, the upward sweep of flange 120, reaching a height sufficient to clear trucks 26 and 28, as the case may be. The upper portion 130 of the dog leg has an exaggerated, or extended, reach to yield a relief, or accessway, indicated generally as 132 between the near wheel 134 of truck 26 or 28, and the truncated end of lower sill tube 86. This extended recess facilitates maintenance and repair of operating mechanisms of car 20, such as brake linkages. It also makes for a more efficient use of material since the depth of section required at mid span is generally greater than that required near the ends of the span for a simply supported beam. This permits a saving in weight.

Figure 8A:
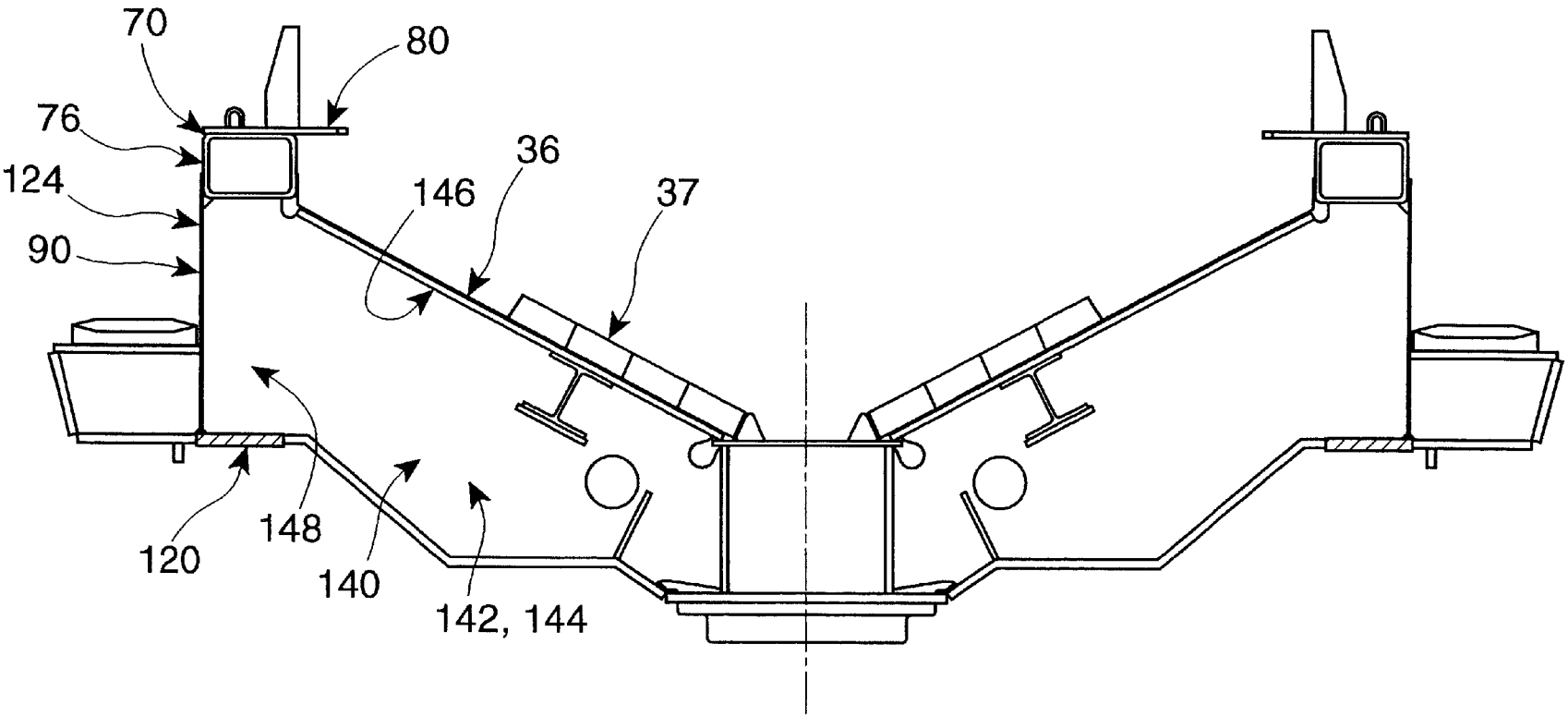
FIG. 8*a* is a cross section of the rail car of FIG. 5*a* at the main bolster.
Figure 8B:
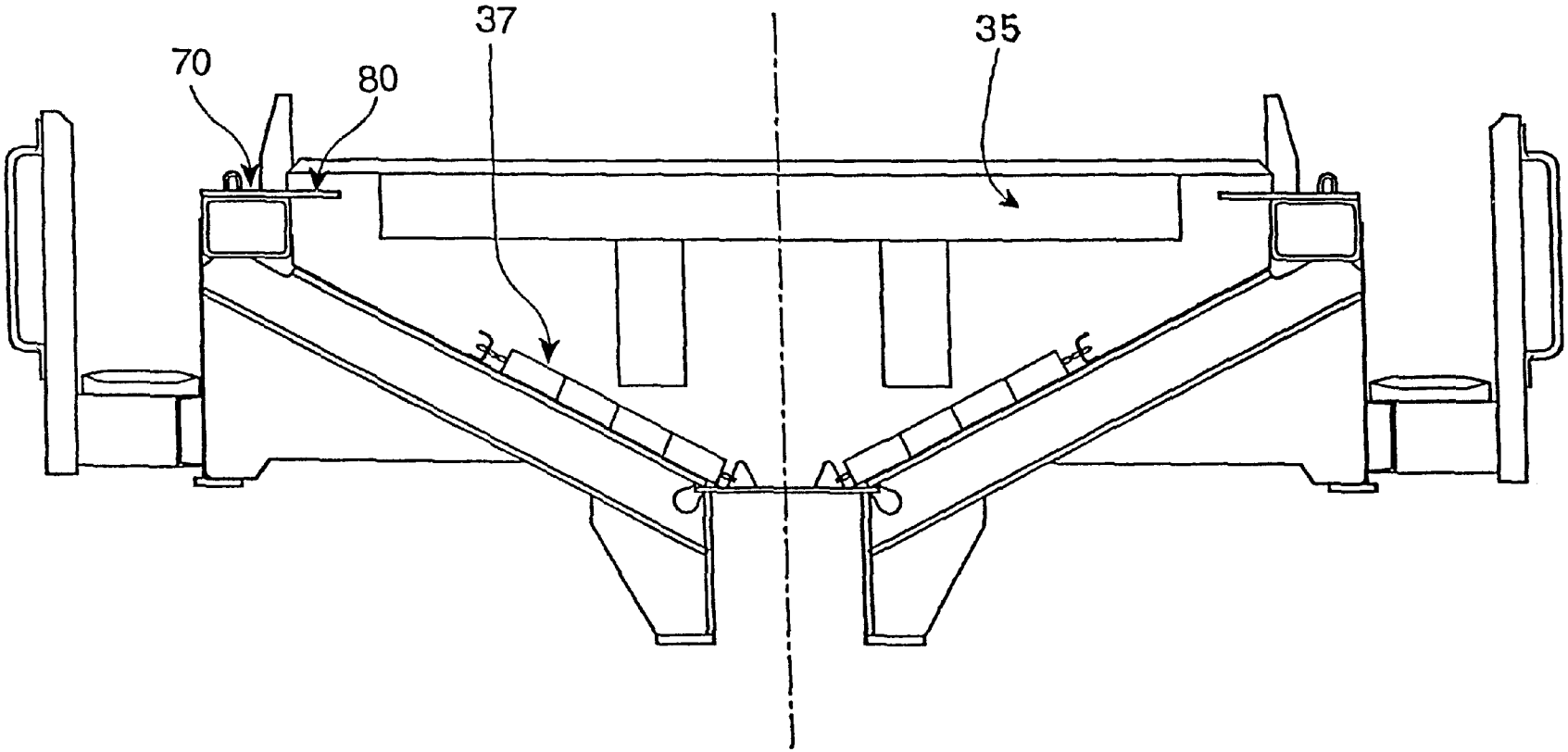
FIG. 8*b* is a cross sectional view of the rail car of FIG. 5*b* toward the end bulkhead.

Moving still further toward the end of car 20, the accumulated vertical shear load in side beams 30 and 32 is carried to trucks 26 and 28 of end structures 22 and 24, as shown in the sectional view of FIG. 8*a*. Main bolster 140 has the form of a laterally extending irregular box with a pair of spaced apart, substantially parallel webs 142 and 144 of significant depth. Webs 142 and 144 extend fully between a stepped lower flange and a sloped upper flange 146 underlying deck plate 36. Webs 142 and 144 have an extending tab 148 that reaches under and supports upper flange assembly 70, abuts the inside face of web 90, and also abuts the top face of upswept flange 120.

In alternative embodiments of the invention to that shown, it would be possible to design a car having a cradle with either a steeper or a shallower slope, with consequent alteration of the height of the center sill relative to the side beams. However, given the relatively higher pliability of the center sill under vertical bending loads as compared to the side beams, it is undesirable for the chord of maximum stress (and therefore strain) to be in the lower flange of the center sill. To that end, the lower flange of the center sill, that is, its lowest extremity, is no lower than the lowest extremity of the side beams. Similarly, the highest compressive stress due to vertical load will occur in the highest portions to top chord assembly 70.

In terms of carrying compressive longitudinal loads between coupler ends, it is advantageous to retain a straight through sill. This implies a relatively high sill since standard coupler height is 33 inches above top of rail to the center of the coupler.

In the embodiment illustrated, the centroid of area of car 20 is at a height just below the top of top flange 50, within the profile of center sill 40. As such, center sill 40 plays only a small role in resistance to vertical bending.

It is possible to benefit from simplified production when all the cross bearers are of the same design, but some benefits can be obtained even when some cross ties remain, whether they are half as numerous, two thirds as numerous, one third as numerous as the cross bearers or some other fraction.

A preferred embodiment has been described in detail and a number of alternatives have been considered. As changes in or additions to the above described embodiments may be made without departing from the nature, spirit or scope of the invention, the invention is not to be limited by or to those details, but only by the appended claims.

I claim:

1. A rail car for carrying metal coils, comprising:

a pair of end structures each mounted on a rail car truck;

a pair of side beams extending between said end structures;

said side beams being the main longitudinal structural elements of said rail car for resisting gravitational loads, each of said side beams having a top chord member, a bottom chord member, and a web member extending between said top and bottom chord members;

a longitudinally running cradle for metal coils, said cradle being mounted between said side beams;

said cradle having sides sloping upwardly and outwardly to either side of a longitudinally extending central structural member;

said structural member being a center sill having an upper flange and a lower flange; and at a location between said trucks, the bottom chords of said side beams being entirely lower than said lower flange of said central structural member.

2. A railcar as claimed in claim 1 wherein said railcar has, at a transverse cross-section between said trucks, a second moment of area about a horizontal neutral axis, and said side beams contribute at least half of said second moment of area of said section.

3. The rail car of claim 2 wherein said side beams contribute at least three quarters of said second moment of area of said section.

4. The railcar of claim 3 wherein said side beams contribute at least 90% of said second moment of area.

5. The rail car of claim 1 wherein at a transverse section between said trucks the location of maximum longitudinal tensile stress under a gravity load is in the bottom chord of one of said side beams.

6. The rail car of claim 5 wherein at a transverse section between said trucks the location of maximum longitudinal compressive stress under a gravity load is in the top chord of one of said side beams.

7. The rail car of claim 1 wherein:

said side beans include vertical stiffeners extending between said top chord members and said bottom chord members;

cross-bearers extend between said center sill and side beams; and said cross-bearers are connected to said vertical stiffeners at a lap joint.

8. The rail car of claim 1 wherein:

said railcar has a neutral axis for bending under gravity loads, and said neutral axis lies at a height that is between the height of said top and bottom flanges of said center sill.

9. The rail car of claim 1 wherein said cradle includes cross-bearers connected to said side beams.

10. The rail car of claim 9 wherein at least a medial portion of said rail car between said trucks is chosen from the set of rail car portions consisting of (a) rail car portions that are free of cross-ties; and (b) rail car portions in which the number of cross ties is fewer than two thirds as many as cross bearers.

11. The rail car of claim 9 wherein:

at least a medial portion of said rail car between said trucks has a plurality of pairs of cross-bearers extending between said center sill and said side beams, and in at least said medial portion said rail car is free of cross-ties between said pairs of cross-bearers.

12. The rail car of claim 9 wherein:

at least a medial portion of said rail car between said trucks has a plurality of pairs of cross-bearers extending between said center sill and said side beams, and in at least said medial portion said rail car has fewer than two thirds as many cross-ties as cross-bearers.

13. The rail car of claim 1 wherein:

at least a medial portion of said rail car between said trucks a plurality of pairs of cross-bearers extend between said side beams and said center sill, said pairs of cross-bearers being spaced along said rail car; and said cross-bearers of at least said medial portion are of uniform design.

14. The rail car for carrying metal coils as claimed in claim 13 wherein at least the medial portion of said rail car is free of cross-ties.

15. The rail car of claim 1 wherein said center sill has a constant cross-section over a medial portion of said car between said trucks.

16. The rail car of claim 15 wherein:

said rail car has a plurality of pairs of cross-bearers extending between said side beams and said center sill, said pairs of cross-bearers being spaced along said rail car; and over at least the medial portion of rail car each pair of cross bearers is of the same design as the others in said medial portion of said rail car.

17. The rail car of claim 15 wherein at least the medial portion of said rail car is chosen from the set of rail car portions consisting of (a) portions that are free of cross-ties; and (b) portions that have less than two-thirds as many cross-ties as cross-bearers.

18. The rail car of claim 1 wherein said side beams have stiffener posts mounted to said webs thereof, said stiffener posts running upwardly between said bottom and top chords.

19. The rail car of claim 18 wherein:

said rail car has cross bearers spaced along said central structural member;

said cross bearers extend between said central structural member and each of said side beams; and said stiffener posts are located abreast of respective ones of said cross bearers.

20. The rail car of claim 19 wherein said cross bearers are connected to said posts at a lap joint.

21. The rail car of claim 18 wherein said stiffener posts are mounted laterally inboard of said web members.

22. The rail car of claim 18 wherein:

said rail car has cross bearers spaced along said central structural member, said cross bearers extend between said central structural member and said side beams;

said stiffener posts have an upper region connected to said top chord, and a lower region connected to said bottom chord; and said cross bearers have laterally outboard ends mating with said upper region of said stiffener posts.

23. A rail car for carrying metal coils comprising:

a pair of end structures each mounted on a rail car truck;

a pair of side beams extending between said end structures;
said side beams having a lowest chord member;

a center sill mounted between said side beams and running between said end structures;
said center sill having a lowest flange;

said lowest chord members of said side beams being entirely lower than said lowest flange of said center sill;

a transverse sling, for cradling metal coils, slung between said side beams and extending above said center sill;

said rail car having a set of brakes; and at least one of said side beams having a relief permitting access to said brakes.

24. The rail car of claim 23 wherein said relief is located adjacent said truck.

25. The rail car of claim 23 wherein said one beam has a relief adjacent each of said trucks.

26. The rail car of claim 23 wherein both said beams have reliefs adjacent said trucks.

27. A rail car for cry metal coils, comprising:

a pair of end structures each mounted on a rail car truck;

a pair of side beams extending between said end structures;

a center sill mounted between said side beams and running between said end structures;
said center sill being a straight through center sill and having a bottom flange;

said side beams each having a bottom chord;

said bottom chords of said side beams being entirely lower than said bottom flange of said center sill;

a longitudinally extending cradle for coils, said cradle being supported by said side beams and said center sill;

said rail car having a transverse cross-section at mid span between said trucks;

said cross-section having a horizontal neutral axis for bending under gravity loads applied to said car;

said cross-section having a second moment of area about said horizontal neutral axis; and said side beams contributing at least half of said second moment of area of said section.

28. A rail car for carrying metal coils, comprising:

a pair of end structures each mounted on a rail car truck;

a pair of side beams extending between said end structures;

said side beams each having a bottom chord;

a center sill mounted between said side beams and running between said end structures;
said center sill being a straight through center sill and having a bottom flange;

said bottom chords of said side beams being entirely lower then said bottom flange of said center sill;

a cradle for cradling metal coils, supported by said side beams and said center sill, said cradle extending along said center sill;

a plurality of pairs of cross-bearers joining said side beams and said center sill, said pairs of cross-bearers being spaced along said rail car; and at least a medial portion of said rail car between said trucks is chosen from the set of rail car portions consisting of
(a) rail car portions that are free of cross-ties; and
(b) rail car portions in which of cross ties are fewer than two thirds as many in number as cross bearers.

* * * * *

UNITED STATES PATENT AND TRADEMARK OFFICE

CERTIFICATE OF CORRECTION

PATENT NO. : 6,543,368 B1
DATED : April 8, 2003
INVENTOR(S) : James W. Forbes

It is certified that error appears in the above-identified patent and that said Letters Patent is hereby corrected as shown below:

Title page,
Item [73], should read:
-- [73] Assignee: National Steel Car Limited, Hamilton (CA) --

Signed and Sealed this

Twenty-eighth Day of October, 2003

JAMES E. ROGAN
*Director of the United States Patent and Trademark Office*